US006822148B2

(12) United States Patent
Yanase

(10) Patent No.: US 6,822,148 B2
(45) Date of Patent: Nov. 23, 2004

(54) ELECTRONIC PAD

(75) Inventor: Hiroyuki Yanase, Shizooka (JP)

(73) Assignee: Roland Corporation, Osaka (JP)

( * ) Notice: Subject to any disclaimer, the term of this patent is extended or adjusted under 35 U.S.C. 154(b) by 100 days.

(21) Appl. No.: 10/013,420

(22) Filed: Dec. 8, 2001

(65) Prior Publication Data

US 2002/0112593 A1 Aug. 22, 2002

(30) Foreign Application Priority Data

Dec. 27, 2000 (JP) ..... 2000-398367

(51) Int. Cl.[7] ..... G10D 13/02
(52) U.S. Cl. ..... 84/422.1; 84/723
(58) Field of Search ..... 84/422.1–422.4, 84/723

(56) References Cited

U.S. PATENT DOCUMENTS

| | | | | |
|---|---|---|---|---|
| 4,102,235 A | | 7/1978 | Le Masters | |
| 4,479,412 A | | 10/1984 | Klynas | |
| 4,581,973 A | | 4/1986 | Hoshino | |
| 5,105,710 A | | 4/1992 | Rothmel | |
| 5,262,585 A | * | 11/1993 | Greene et al. | 84/645 |
| 5,293,000 A | | 3/1994 | Adinolfi | |
| 5,492,047 A | | 2/1996 | Oliveri | |
| 5,493,942 A | | 2/1996 | Wolf | |
| 5,915,289 A | * | 6/1999 | Hart | 84/738 |
| 5,922,980 A | | 7/1999 | Arteaga | |
| 5,965,834 A | * | 10/1999 | Suenaga et al. | 84/422.3 |
| 5,969,281 A | | 10/1999 | Suenaga | |
| 5,977,473 A | * | 11/1999 | Adinolfi | 84/723 |
| 6,031,176 A | | 2/2000 | Tanaka | |
| 6,072,112 A | * | 6/2000 | Suenaga et al. | 84/422.3 |
| 6,331,667 B1 | | 12/2001 | Kuppers | |

FOREIGN PATENT DOCUMENTS

| | | |
|---|---|---|
| JP | 5-143071 | 6/1993 |

* cited by examiner

*Primary Examiner*—Jeffrey W Donels
(74) *Attorney, Agent, or Firm*—Foley & Lardner LLP

(57) ABSTRACT

An electronic pad generates a sound imitating a tone generated during a musical performance by an acoustic percussion instrument. In some examples, an electronic hi-hat cymbal imitates the sound created by an acoustic hi-hat cymbal without having to correct for uneven detection of striking sensitivity. The electronic pad includes a striking sensor, a striking surface, and a bowl-shaped frame that is curved such that the sensor detects vibration waveform data according to the striking force of a strike against the striking surface.

20 Claims, 10 Drawing Sheets

ELECTRONIC PAD

CROSS-REFERENCE TO RELATED APPLICATIONS

Embodiments of the present invention relate to and claim priority to Japanese Patent Application No. 2000-398367, filed on Dec. 27, 2000.

BACKGROUND OF THE INVENTION

1. Field of the Invention

The present invention relates to an electronic pad for use as an electronic percussion instrument, and in certain embodiments, for use as an electronic hi-hat cymbal.

2. Description of the Related Art

In recent years, electronic musical instruments have secured a position not simply as an alternative to acoustic musical instruments but as musical instruments capable of generating tones of various timbers with various effects.

One such electronic musical instrument is an electronic percussion instrument that imitates an acoustic percussion instrument. One technique relating to electronic percussion instruments, and specifically, a technique for allowing an electronic percussion instrument to generate tones similar to those of an acoustic percussion instrument, is disclosed in Japanese Patent Application Laid-Open (JP-A) No. 5-143071, which is incorporated herein by reference.

According to the electronic percussion instrument disclosed in JP-A No. 5-143071, a phenomenon occurs such that the initial amplitudes of vibrations caused by percussive strikes against the instrument may vary depending on where the instrument was struck. Moreover, the initial amplitudes of such vibrations may vary even if different parts of the instrument are struck with an equal striking force.

Next, experimental data on the above described phenomenon will be described.

FIG. 1 shows an electronic pad 7 similar to an embodiment of the electronic pad disclosed in JP-A No. 5-143071. The electronic pad 7 has a frame 2 that transmits a vibration of a strike, a striking sensor 1 that detects the vibration of a strike wherein the striking sensor 1 is arranged on the central portion of the lower surface of the frame 2, and a cover 3 which is in contact with the frame 2 and that covers the upper surface of the frame 2.

FIG. 2 is a top view of the electronic pad 7 shown in FIG. 1. For illustrative purposes, the striking sensor 1, which would not normally be seen in a top view, is shown. The striking surface of this electronic pad 7 is the area inside a circle having the radius A (A being measured from the center of the electronic pad 7). As shown in FIG. 2 and for purposes of discussion herein, a point a distance 'a' away from the center of the electronic pad 7 will be referred to as a point "inside," a point away therefrom by distance 'b' will be a point "middle," and a point away therefrom by distance 'c' will be a point "outside." The ratios of the distances 'a', 'b', and 'c' to the radius A are 10%, 50%, and 90%, respectively.

FIG. 3 is a waveform view showing waveforms of vibrations detected by the striking sensor 1 (shown in FIG. 2). The three waveforms correspond to when points "inside", "middle," and "outside" on an electronic pad are struck by a percussion member, such as a stick, with an equal striking force. The solid line indicates a waveform detected when the point "inside" is struck, the dashed line indicates the waveform when the point "middle" is struck, and the dotted line indicates the waveform when the point "outside" is struck.

A comparison of the amplitudes of the waveforms shows that the initial amplitude of the waveform corresponding to when the point "inside" is struck is the highest. The initial amplitude of the waveform corresponding to when the point "outside" is struck is the lowest. The initial amplitude of the waveform corresponding to when the point "middle" is struck is in between the others.

In the case of an acoustic percussion instrument, the volume thereof does not depend on the striking position on the striking surface. Instead, a sound is generated with a volume closely related to the strength of the strike (the "striking strength"). A conventional electronic percussion instrument, by contrast, may not generate a sound with a volume related to the striking strength because of the above-described phenomenon. The initial amplitudes of the waveform vibrations may vary even though different positions may be struck with the same striking strength.

Accordingly, conventional electronic percussion instruments may need to detect a striking position as well as a striking strength. By accounting for a striking strength as well as a striking position, an electronic percussion instrument may correct the volume so that a sound may be generated with a volume according to the striking strength irrespective of the striking position.

Therefore, conventional electronic percussion instruments, to accurately correct the volume according to the striking strength, may also need to detect the striking position. Further, to generate a sound without creating a delay from the time of the strike, any volume corrections must be done very quickly. Accordingly, it is a disadvantage of conventional electronic pads that they may have to promptly detect striking position and correct the detected striking strength.

SUMMARY OF THE DISCLOSURE

In view of the above, it is an object of embodiments of the present invention to provide an electronic pad that may detect a striking force without having to detect or account for the striking position.

To obtain the above-described object, an electronic pad according to embodiments of the present invention may comprise:

- a disk-shaped or bowl-shaped frame curved upward or downward;
- a striking sensor in contact with the frame; and
- a cover in contact with, and covering, an upper surface of the frame, and formed out of a softer material than the material of the frame.

The frame 2 of a conventional electronic pad may be constituted out of a flat plate as shown in FIG. 1. The electronic pad according to the present invention, by contrast, may have a disk-shaped or bowl-shaped frame curved upward or downward. Due to the shape of the frame, a strike against an outer peripheral portion of the electronic pad may be transmitted to the striking sensor without being greatly attenuated as compared to a strike against a position inside of the outer peripheral portion.

In some embodiments of the present invention, the frame of the electronic pad may be convex and curved upward. Also, the striking sensor may be situated such that it is in contact with a central portion of a lower surface of the frame.

In addition, in some embodiments of the present invention, the electronic pad may further comprise a chassis having a protrusion on one surface that forms a circle or a ring. In such embodiments, the cover may extend around to a lower surface of the outer edge portions of the frame, thereby holding the frame. In these embodiments, the chassis supports the outer peripheral edge portions of the frame, with a portion of the cover being interposed between the chassis and the frame. Further, in some embodiments of the invention, the outer edge of the frame may not be extended beyond the protrusion of the chassis.

Embodiments of the invention may also employ a sheet sensor for detecting an applied pressure on edge portions of the cover. The sheet sensor may be disposed at a position on an upper surface of the chassis outside of the chassis protrusion. In such embodiments, the cover may have a cover protrusion on its bottom surface that may press the sheet sensor in response to a strike against the upper surface of the cover. In this embodiment, the cover may also have a hollow portion outside of the protrusion.

In electronic pads according to embodiments of the present invention, a portion of the cover near the striking sensor may be formed thicker than other portions of the cover. If the portion of the cover under which the striking sensor is provided is formed to be thicker than the other portions of the cover, then a strike against the cover above the striking sensor may be attenuated so that such a strike is not detected more excessively than strikes against other portions of the cover.

In electronic pads according to further embodiments of the present invention, a surface treatment may be applied to the cover, such as a rubber primer. The cover may also have concentric concave and convex configurations on a surface of the cover.

DETAILED DESCRIPTION OF PREFERRED EMBODIMENTS

Figure 4:
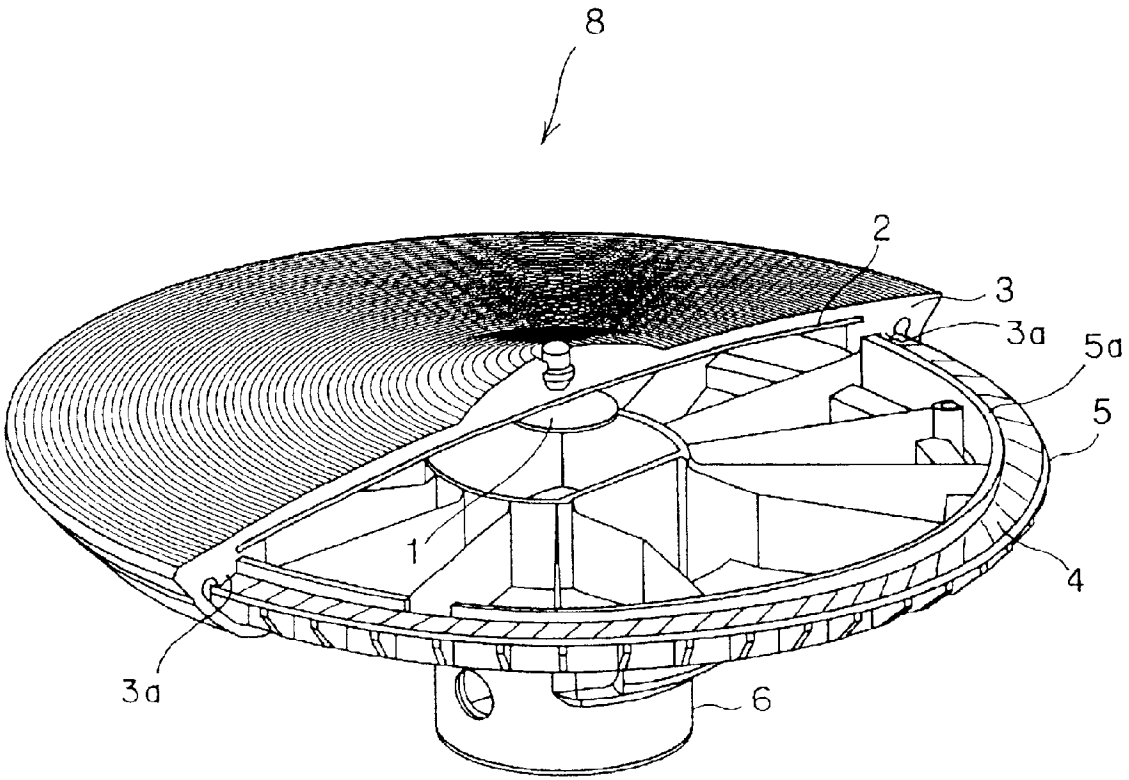
FIG. 4 shows a partially cut-away view of an electronic hi-hat cymbal according to an embodiment of the present invention.

One embodiment of the present invention involves an electronic hi-hat cymbal. FIG. 4 illustrates an arrangement of sensors employed in an electronic hi-hat cymbal 8 according to an embodiment of the present invention. For illustrative purposes, portions of the frame 2 and of the cover 3 are not shown in this view.

As shown in FIG. 4, the upper surface of the frame 2 may be covered with the cover 3. The outer peripheral edge portions of the frame 2 may be supported by a chassis protrusion 5*a* of a chassis 5. Portions of the cover 3 may be interposed between the chassis 5 and the frame 2. A piezoelectric sensor 1 (which is an example of a striking sensor according to embodiments of the present invention) may be disposed to be in contact with the central portion of the lower surface of the frame 2. The piezoelectric sensor 1 may detect a strike as a waveform of a vibration. In addition, a sheet sensor 4 may be disposed near the outer peripheral edge portions of the chassis 5.

Figure 5:
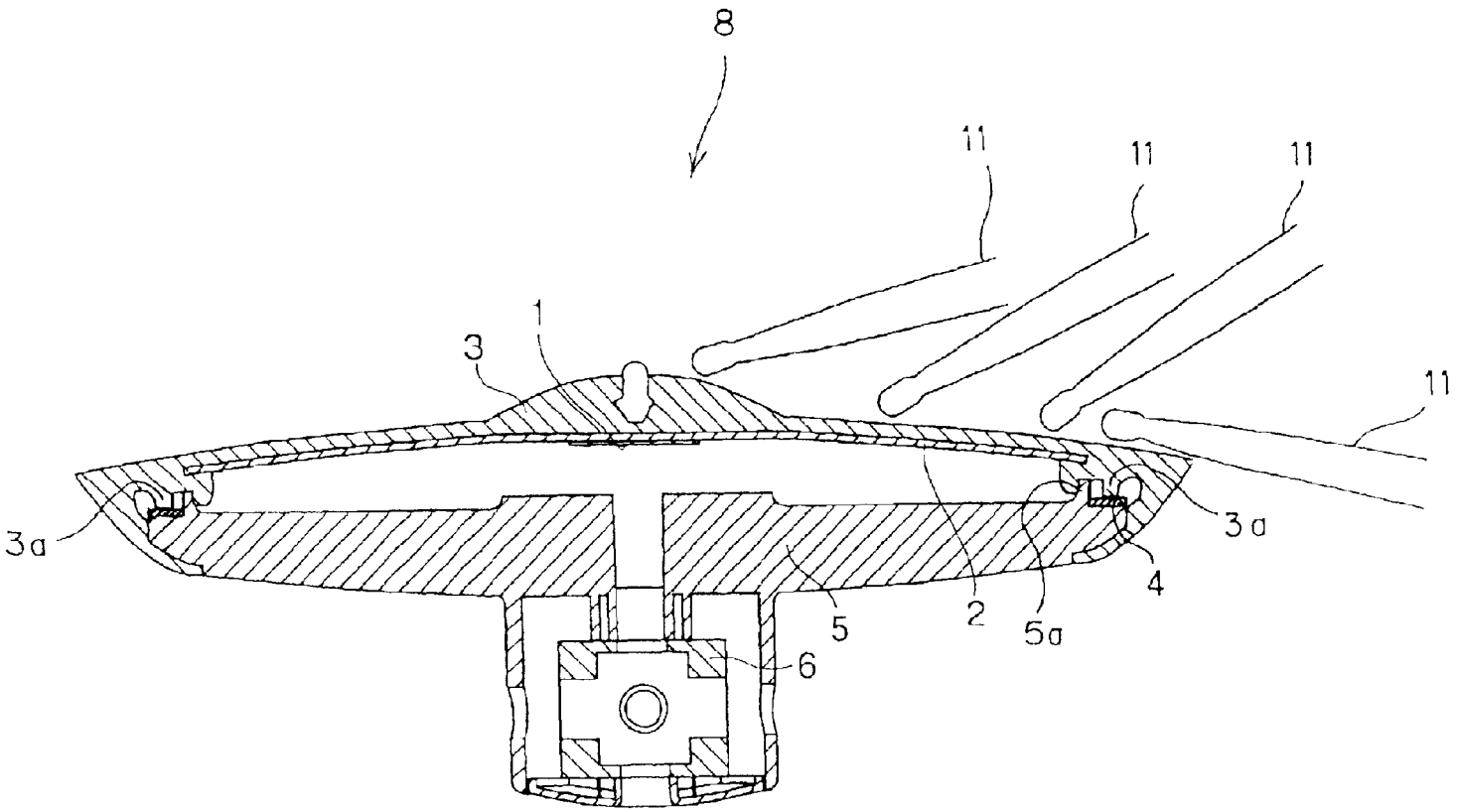
FIG. 5 shows a cross-sectional view of an electronic hi-hat cymbal according to an embodiment of the present invention.

FIG. 5 is a cross-sectional view of the electronic hi-hat cymbal 8 shown in FIG. 4, according to an embodiment of the invention. In FIG. 5, the entire upper surface of the cover 3 may comprise a striking surface of the electronic hi-bat cymbal 8. The outer edge of the cover 3 may also serve as a striking surface.

FIG. 5 shows a state in which points corresponding to the striking points designated as "inside," "middle," and "outside" (shown in FIG. 2), as well as the outer edge of the cover 3, of the electronic hi-hat cymbal 8, are struck by percussion sticks 11.

Figure 2:
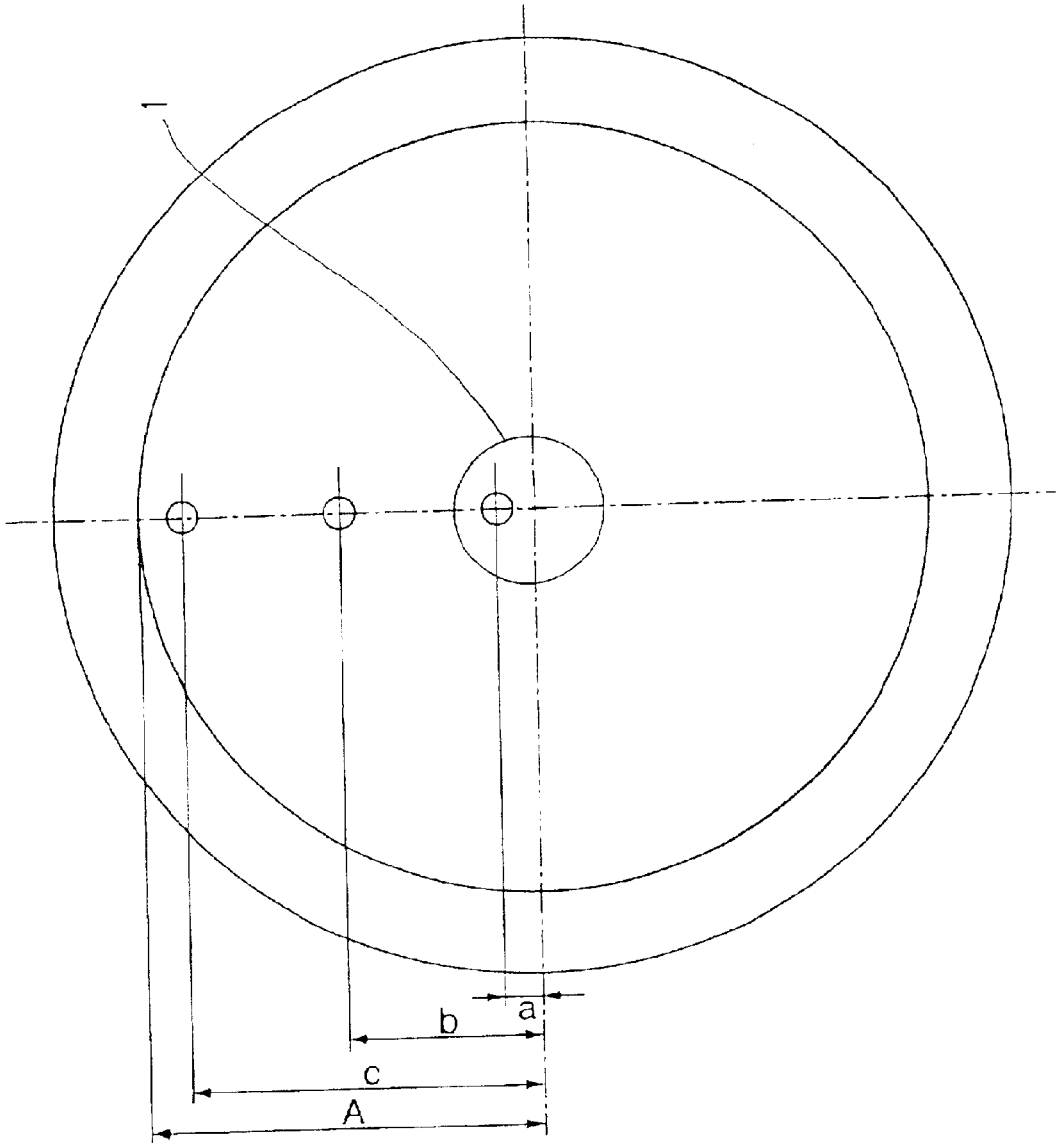
FIG. 2 shows a top view of a conventional electronic pad.
Figure 3:
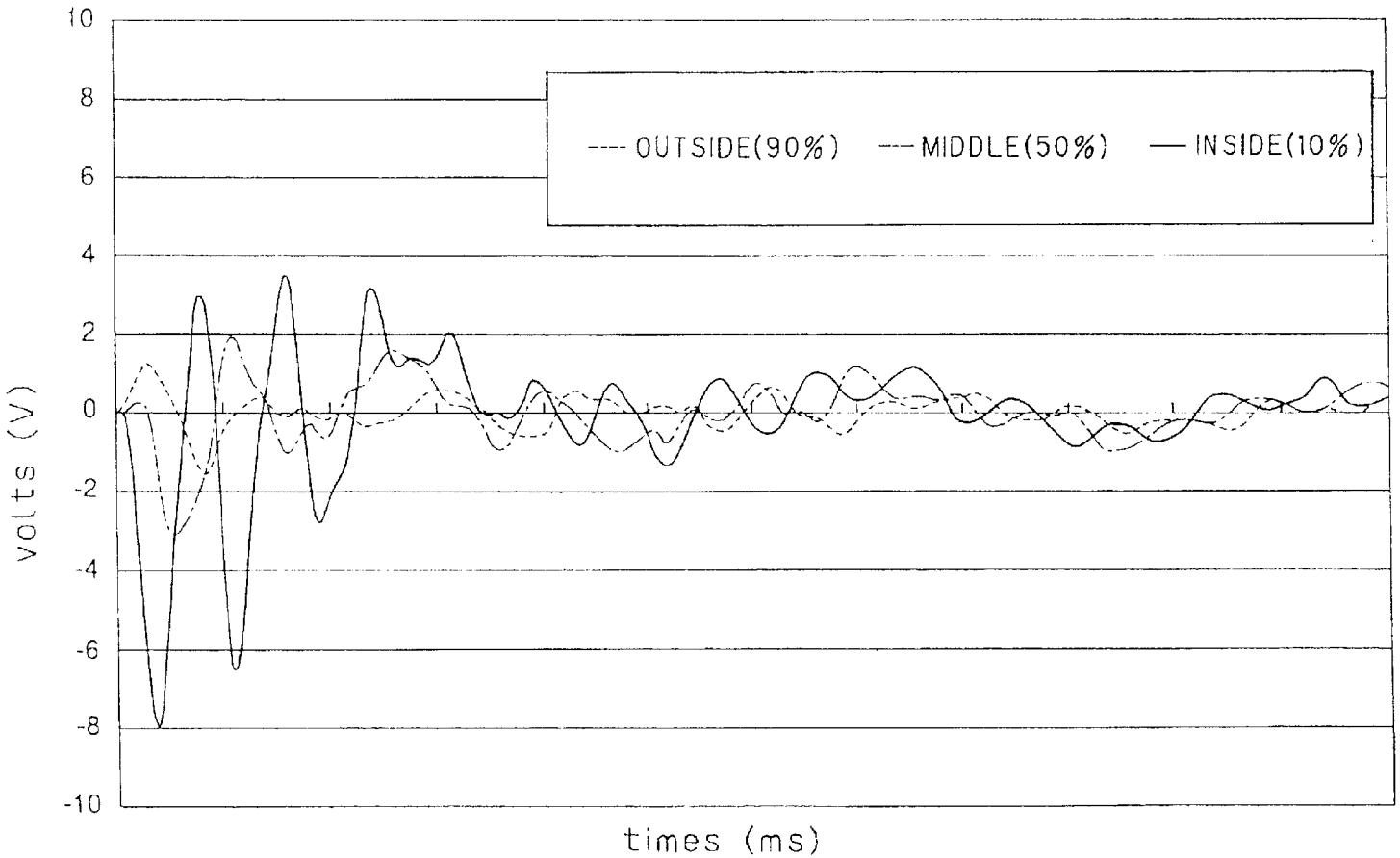
FIG. 3 is a waveform view showing waveforms of vibrations detected when points designated as "inside","middle" and "outside" in a conventional electronic pad are struck by a percussion stick with an equal striking force.

With respect to the electronic hi-hat cymbal 8 shown in FIG. 5, the distance A (as shown in FIG. 2) is the radius of the frame. The ratios of the distances, from the center of the frame 2 to points "inside," "middle," and "outside," to the radius A, are 10%, 50%, and 90%, respectively. These ratios are the same as those discussed with respect to FIG. 2. Other embodiments may employ other suitable ratios.

Embodiments of the electronic hi-hat cymbal 8 shown in FIG. 5 may have a generally bowl-shaped frame 2 made of a hard material and curved upward. The bowl-shape of frame 2 may be the shape of a portion of a sphere. Alternatively, other bowl-shaped curvatures may be employed for frame 2. As a material for this frame 2, a metal such as iron, a hard plastic material such as ABS or polycarbonate, or any like material, may be used. The outer peripheral edge portions of the frame 2 are supported by the chassis protrusion 5*a*. A portion of the cover 3 may be interposed between the chassis 5 and the frame 2. According to this configuration, if the upper surface of the electronic hi-hat cymbal 8 is struck, the frame 2 vibrates with the outer peripheral portions acting as fulcrums. The vibration of the frame 2 may be transmitted to the piezoelectric sensor 1, which is in contact with the central portion of the lower surface of the frame 2 in this embodiment. Based on an electric signal generated in response to the vibration transmitted to this piezoelectric sensor 1, a striking force and a striking position may be detected by various well-known detection methods.

Even if this embodiment of the electronic hi-bat cymbal 8 is continuously struck at short intervals (fast), a vibration generated by the strike may be attenuated relatively quickly because the cover 3 covers the frame 2, and the cover 3 is interposed between the frame 2 and the protrusion 5*a* of the chassis 5. Therefore, even fast strikes may be accurately detected on an individual basis.

Moreover, embodiments of the electronic hi-hat cymbal 8 may be provided with the cover 3 covering the upper surface of the frame 2 and made of a softer material than that of the frame 2. The cover 3 may be formed out of rubber, an elastomer, or any like material, which may have both elasticity and durability. The cover 3 provides a striking surface. Therefore, it may be desirable for the cover to be sufficiently hard so that the percussion stick has adequate rebound.

In embodiments of the invention, a surface treatment may be applied to the surface of the cover 3 in order to suppress the friction coefficient of the surface, to gloss the surface, and/or to improve the abrasion resistance of the surface. The surface treatment may make it easier to smoothly slide the percussion stick on the surface. The surface treatment may also help to protect the cover 3, which may be struck by a percussion stick many times. For the surface treatment, a rubber primer or the like may be applied by means of, for example, dipping, brushing or spraying, or by other like means. Also, the cover 3 may be formed of a material having the same effect as that of the surface treatment. In any event, the cover should generally be softer than the frame 2. The surface treatment may also be applied to the outer peripheral edge portions of the cover 3 and to a cover protrusion 3*a*, which presses on the sheet sensor 4, so as to prevent abrasion.

Figure 6:
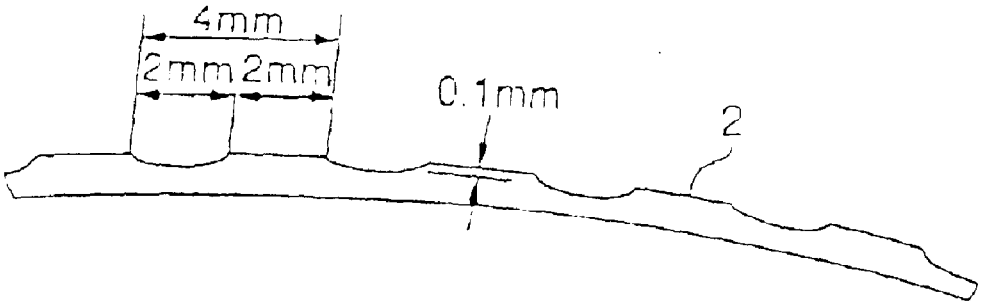
FIG. 6 shows a cross-sectional view of a part of a cover covering the upper surface of an electronic hi-hat cymbal according to an embodiment of the present invention.

In embodiments of the invention, the surface of the cover 3 may be configured to have concentric concave and convex configurations as shown in FIG. 6. In one embodiment, the concave and convex configurations may be, for example, grooves with a width of 2 mm, a pitch of 4 mm (2 mm between the grooves), and a depth of 0.1 mm. Each convex portion may be subjected to embossing (a processing for lightly roughening a surface). As a result of the processing, a metallic gloss (light reflection) may be obtained. Accordingly, the appearance of the electronic hi-hat cymbal 8 may be akin to the appearance of an acoustic cymbal. Also, there may be an effect of reducing the abrasion of the cover 3 due to striking with a percussion stick.

An electronic hi-hat cymbal 8 according to further embodiments of the invention may include the chassis 5 constituting a lower portion of the electronic hi-hat cymbal 8. As a material for this chassis 5, hard plastic, such as ABS or polycarbonate, may be used as may any like material. A stand holder 6 may be assembled into the lower portion of the center of the chassis 5. By fitting a stand (not shown) into the stand holder 6, and fixing the stand to the stand holder 6, the electronic hi-hat cymbal 8 may be supported by the stand.

Further, a sheet sensor 4 may be disposed between the fitted portions of the frame 2 and the chassis 5. The sheet sensor 4, which is ring-shaped, may detect a strike when the outer edge of the cover 3 of the electronic hi-hat cymbal 8 is struck.

To actuate the sheet sensor 4, the cover protrusion 3*a* may be provided on the outer peripheral edge portions of the cover 3. The cover protrusion 3*a* may be formed outside of the outer periphery of the protrusion 5*a*. As a result, if the edge portion of the electronic hi-hat cymbal is struck, the outer peripheral edge portions of the cover 3 are deformed and the cover protrusion 3*a* may actuate the sheet sensor 4.

Further, the chassis 5 may support the frame 2 by the cover 3 using the a protrusion a as described above. In addition, the chassis 5 may be configured so that the edge of the frame 2 does not extend outside of the protrusion 5*a* (i.e., the frame 2 is smaller in size than the outside diameter of the protrusion 5*a*).

Moreover, by providing a hollow portion outside of the cover protrusion 3*a* (the portion that actuates the sheet sensor 4), the outer peripheral edges of the cover 3 may be deformed more easily when struck. This deformation may create a feel that is similar to striking the edge portion of an acoustic hi-hat cymbal. An acoustic hi-hat cymbal is constituted out of two cymbals, one of which faces and rests on the other. When the edge portion of an acoustic hi-hat cymbal is struck, the two cymbals are shifted to thereby convey a feeling as if the striking portion was deformed. The electronic hi-hat cymbal 8 in this embodiment may give a sense or feel of a strike that is similar to that of the acoustic hi-hat cymbal because the edge portion of the cover 3 may be deformed as described above.

Here, when the striking surface of the electronic hi-hat cymbal 8 or the outer edge of the cover 3 is struck by a percussion stick 11, a generated vibration may be detected by the striking sensor 1, as shown in FIG. 5. When only the outer edge of the cover 3 is struck, not only does the striking sensor, 1 detect the vibration, but the sheet sensor 4 may also detect a strike. While the striking sensor 1 detects vibrations relative to all types of strikes against the striking surfaces, including strikes against the outer edge of the cover 3, the sheet sensor 4 may only detect strikes against the outer edge of the cover 3.

A cable, or the like, that could be attached to the electronic hi-hat cymbal 8, is not shown in FIG. 5.

Figure 7:
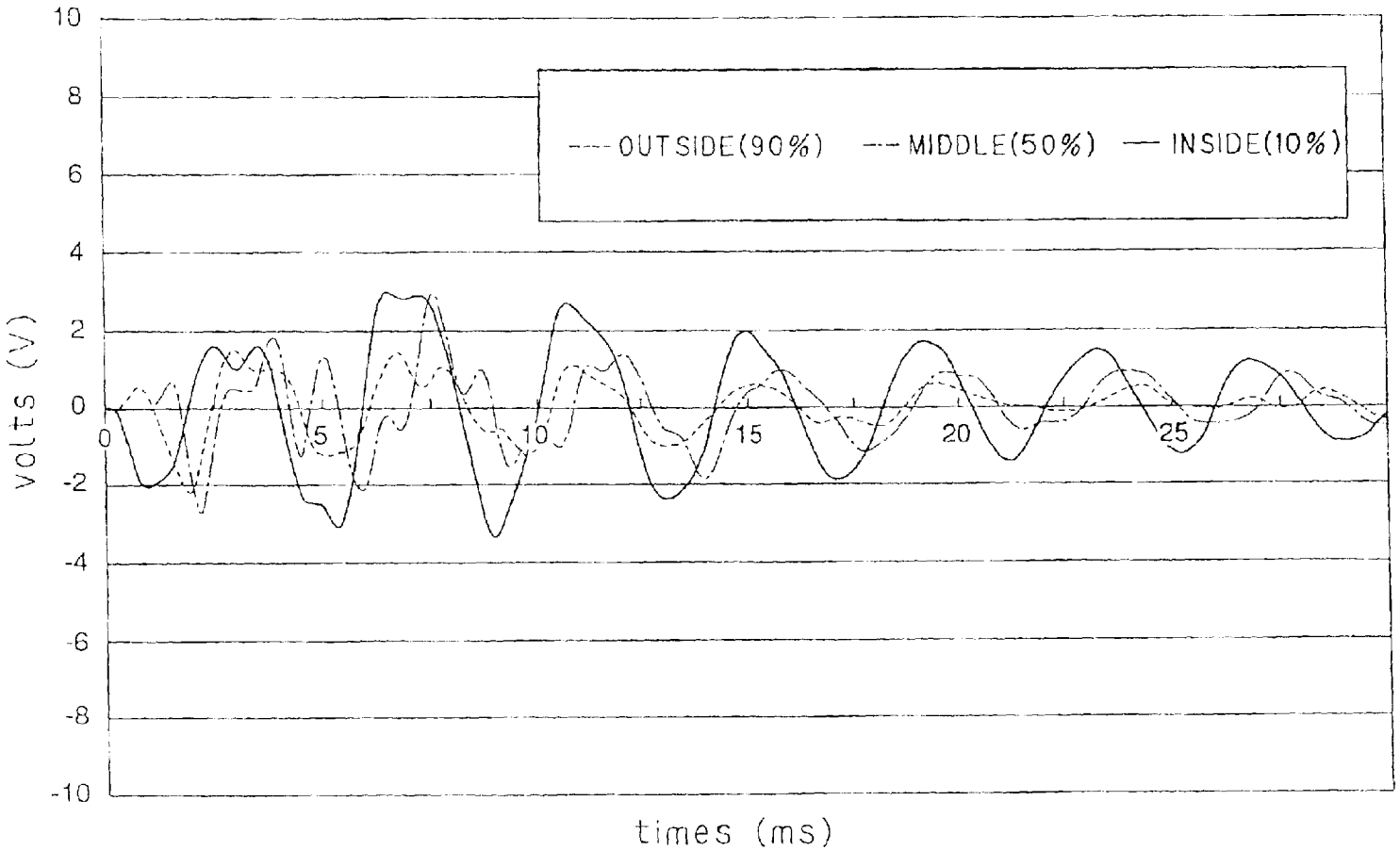
FIG. 7 is a waveform view showing waveforms of vibrations detected when points designated as "inside," "middle," and "outside" of an electronic hi-hat cymbal, according to an embodiment of the present invention, are struck with an equal striking force.

FIG. 7 is a waveform diagram showing waveforms of vibrations detected by the striking sensor 1 when points designated as "inside", "middle", and "outside" (shown in FIG. 2) are struck with an equal striking force, according to embodiments of the invention illustrated in FIGS. 4 and 5. In FIG. 7, a solid line indicates a waveform detected when the point "inside" is struck, a dashed line indicates a waveform detected when the point "middle" is struck, and a dotted line indicates a waveform detected when the point "outside" is struck.

Although distances from these striking points to the striking sensor 1 differ from one another, the initial amplitudes of waveforms of vibrations detected by the striking sensor 1 are almost equal.

That is to say, this embodiment of an electronic hi-hat cymbal 8 according to the invention may accurately detect striking strength without having to also detect striking position. Accordingly, a vibration having an amplitude according to a striking force may be accurately transmitted to the striking sensor no matter which point is struck by the percussion stick. Therefore, the waveform of a vibration obtained by the striking sensor may be used to generate a sound without having to first correct the waveform according to the striking position.

Next, another embodiment of the present invention will be described.

Figure 8:
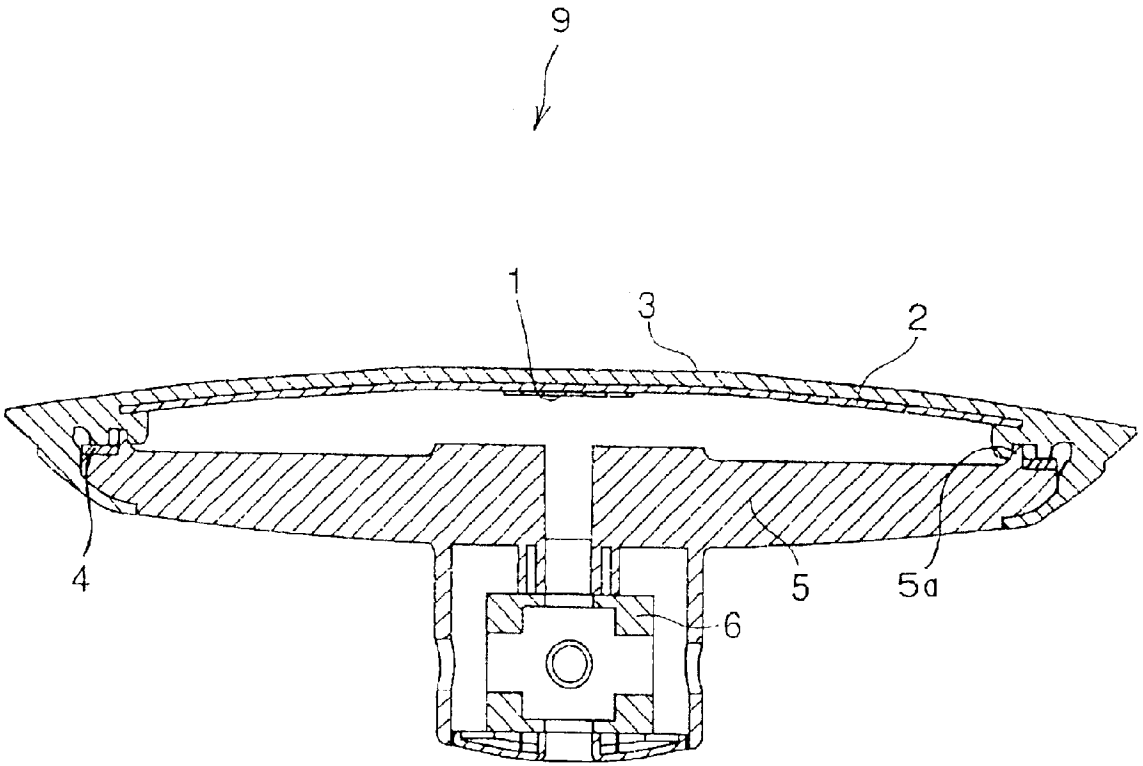
FIG. 8 shows a cross-sectional view of an electronic hi-hat cymbal according to an embodiment of the present invention.

In the example embodiment described above, the central portion of the electronic hi-hat cymbal 8 (the portion of the cover 3 above where the piezoelectric sensor 1 is disposed) may be thicker than the rest of the cover 3. Accordingly, the striking force, as described above, may be attenuated. Such a configuration prevents a strike against the central portion from being detected more excessively than strikes against the other portions. FIG. 8 shows an electronic hi-hat cymbal according to another embodiment of the invention wherein the central portion of the cover of the electronic hi-hat cymbal may be made equal in thickness to the other portions of the cover. In such an embodiment, a frame 2 may be bowl-shaped or disk-shaped, as is the frame in the embodiment described above. FIG. 8 is a cross-sectional view of an electronic hi-hat cymbal 9 according to this embodiment of the invention.

In this embodiment illustrated in FIG. 8, the points on this electronic hi-hat cymbal 9 corresponding to the striking points designated as "inside," "middle," and "outside" (shown in FIG. 2) may be superimposed on the electronic hi-hat cymbal 9. Waveforms detected when these three striking points are struck are shown in the waveform view of FIG. 9.

Figure 1:
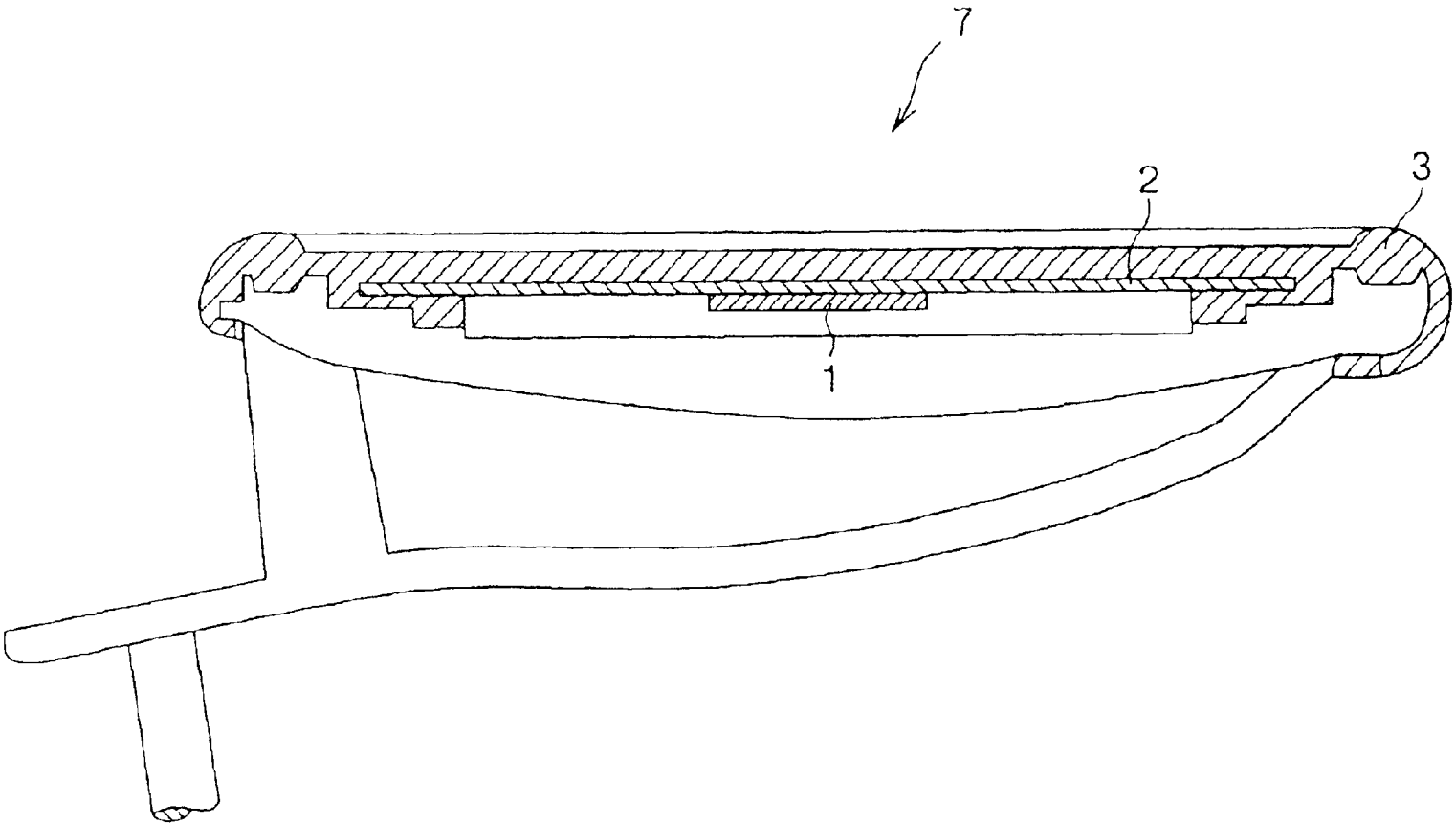
FIG. 1 shows a cross-section view of a conventional electronic pad.
Figure 9:
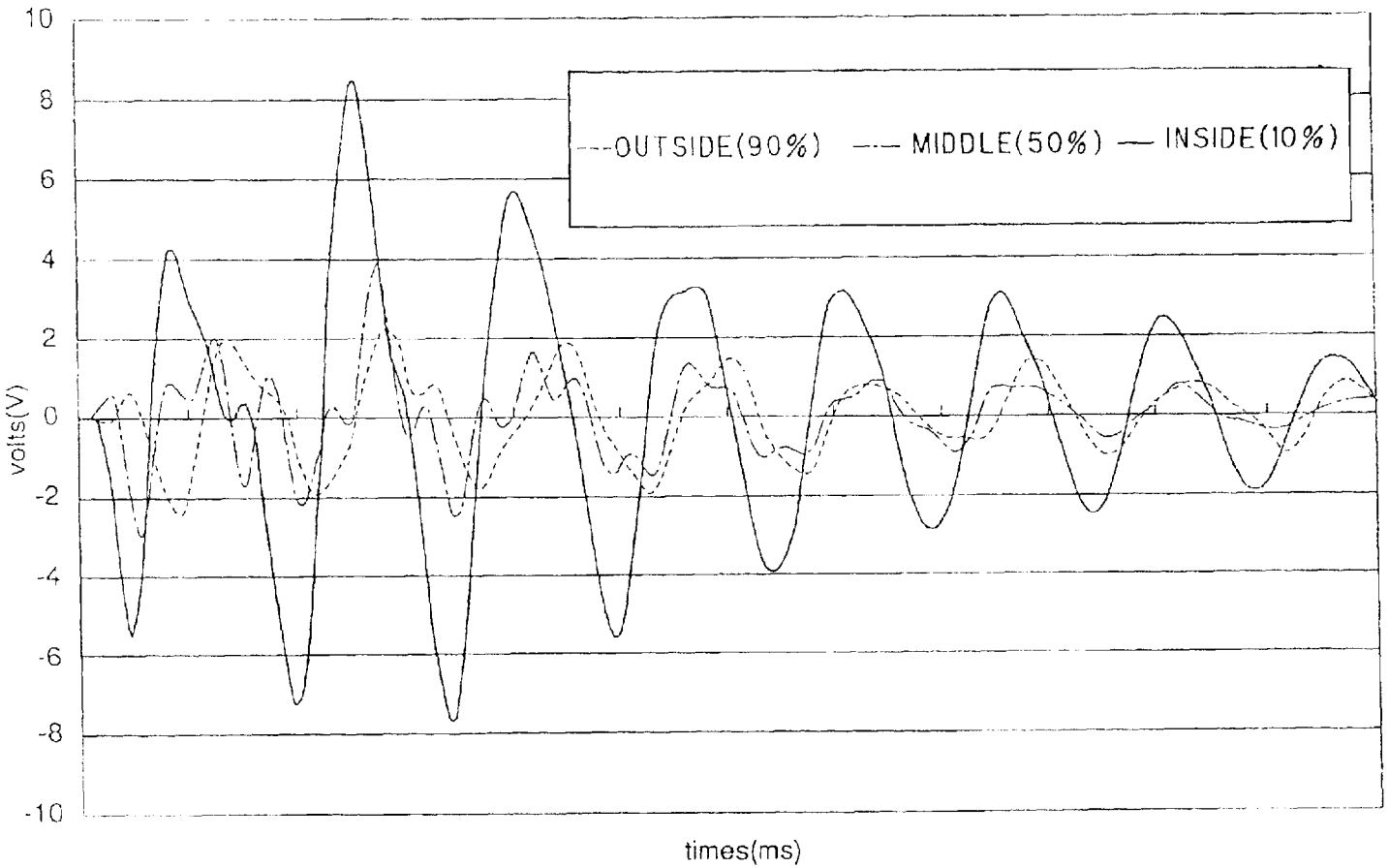
FIG. 9 is a waveform view showing waveforms of vibrations detected when points designated as "inside," "middle," and "outside" of an electronic hi-hat cymbal, according to an embodiment of the present invention, are struck with an equal striking force.

As illustrated in FIG. 9, if the above-described three points on the electronic hi-hat cymbal 9 in FIG. 8 are struck with an equal striking force, the amplitudes of the waveforms of vibrations at the points "middle" and "outside," as detected by the piezoelectric sensor 1 (i.e., the strengths of the vibrations), are almost equal. Accordingly, the electronic hi-hat cymbal 9 in FIG. 8 is improved from the conventional electronic pad in FIG. 1.

In other words, in the case of the electronic hi-hat cymbal 9 shown in FIG. 8, a striking sensor 1 may detect a waveform of a vibration according to a striking force irrespective of the distance of a striking point to the striking sensor 1. This holds true for a large area outside of the point "middle."

Next, another embodiment of the present invention will be described.

In the embodiments described above, the examples of the electronic hi-hat cymbals each had the frame 2 configured to be convex upward, bowl-shaped, or shaped as a portion of a sphere. In another embodiment illustrated in FIG. 10, an example of an electronic drum pad 10 has a frame 2 that is curved downward. This embodiment has a central portion of a cover that may be formed to be sufficiently thick so that a striking surface may be flat. By curving the frame and thickening the portion of the cover 3 above the piezoelectric sensor 1, all striking strengths of equal strength may be detected by the striking sensor as equal in strength.

Figure 10:
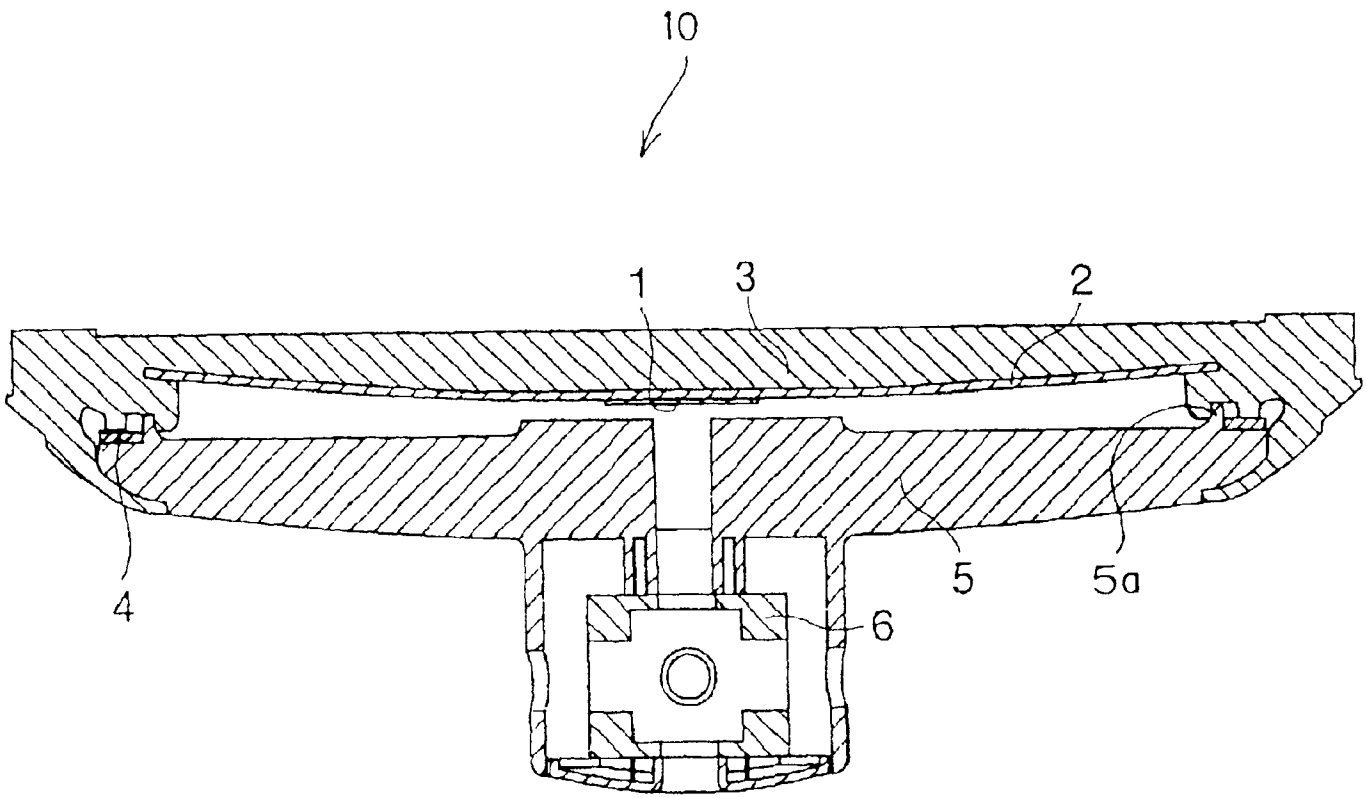
FIG. 10 shows a cross-sectional view of an electronic drum pad according to an embodiment of the present invention.

FIG. 10 is a cross-sectional view of an electronic drum pad 10 according to this embodiment of the invention. In FIG. 10,the frame 2 of the electronic drum pad 10 is curved downward. Even with the frame 2 curved downward, the sensitivity distribution from a point "middle" to a point "outside" on a striking surface becomes flat.

Further, since the portion of the cover 3 above the striking sensor 1 is formed to be sufficiently thick, the sensitivity distribution of the point "inside" may be flat, as well.

In the above-described embodiments, the sheet sensor 4 is disposed between the fitted portion of the cover 3 and the fitted portion of the chassis 5. The sheet sensor 4 may be embedded within the outer edge portion of the cover 3 so long as the sheet sensor 4 can detect a strike against the outer edge of the cover 3.

Moreover, the sheet sensor 4 is not limited to a sheet-like sensor, but it may also be any other kind of sensor capable of detecting a strike against the outer edge of the cover 3. The sheet sensor 4 may be provided to detect a strike against the outer edge of the cover 3. By detecting strikes against the outer edge, the electronic pad may imitate a sound generated when the peripheral edge of the striking surface of an acoustic percussion instrument, or the like, is struck. Therefore, other embodiments of the invention may not include a sheet sensor 4 at all if the detection of edge strikes is not desired.

As described above, embodiments of the electronic pad according to the present invention make it possible to obtain striking data having less dependence on a striking position than in conventional electronic pads.

While particular embodiments of the present invention have been shown and described, it will be obvious to those skilled in the art that the invention is not limited to the particular embodiments shown and described and that changes and modifications may be made without departing from the spirit and scope of the appended claims.

What is claimed is:

1. An electronic pad comprising:

a disk-shaped frame curved upward or downward;

a striking sensor contacting with the frame;

a cover contacting with and covering a first surface of the frame, and formed out of a softer material than a material of the frame; and a chassis supporting the frame;

wherein the chassis has a convex-up chassis protrusion in the form of a circle;

wherein the cover extends around an outer peripheral edge portion of a second surface of the frame so that the cover holds the frame;

wherein the chassis supports the outer peripheral edge portions of the frame using the chassis protrusion with a portion of the cover being interposed between the chassis protrusion and the frame; and wherein the chassis protrusion is formed such that an outer edge of the frame does not extend beyond the chassis protrusion.

2. An electronic pad according to claim 1, wherein the electronic pad further comprises:

a sheet sensor for detecting an applied pressure, and wherein the sheet sensor is disposed on a first surface of the chassis outside of the chassis protrusion; and wherein the cover has a convex-down cover protrusion for pressing the sheet sensor in response to a strike, wherein the cover protrusion is disposed outside of the chassis protrusion, and wherein the cover has a hollow portion outside of the chassis protrusion.

3. An electronic pad according to claim 1, wherein a portion of the cover near the striking sensor is thicker than other portions of the cover.

4. An electronic pad according to claim 1, wherein a surface treatment is applied to the cover.

5. An electronic pad according to claim 4, wherein the surface treatment is applied using a rubber primer.

6. An electronic pad comprising:

a disk-shaped frame curved upward or downward;

a striking sensor contacting with the frame;

a cover contacting with and covering a first surface of the frame, and formed out of a softer material than a material of the frame; and a chassis supporting the frame;

wherein the cover has concentric concave and convex configurations on a surface of the cover.

7. An electronic pad for receiving a strike, detecting the strike, and outputting a signal representative of the strike, comprising:

a bowl-shaped frame having a first surface and a second surface;

a cover that covers the first surface of the frame;

a chassis supporting the frame and a striking sensor disposed to be in percussive communication with the second surface of the frame, the striking sensor for detecting and outputting a signal representative of a strike on the cover;

wherein the chassis has a ring-shaped chassis protrusion; and wherein portions of the cover are disposed between the chassis protrusion and the frame.

8. An electronic pad according to claim 7, wherein an outer edge of the frame does not significantly extend beyond the chassis protrusion.

9. An electronic pad according to claim 7, wherein the electronic pad further comprises a sheet sensor that is disposed near the outer edge of the frame.

10. An electronic pad according to claim 7, wherein the electronic pad further comprises:

a sheet sensor disposed on a first surface of the chassis outside of the chassis protrusion; and wherein a portion of the cover is formed to be in contact with the sheet sensor.

11. An electronic pad according claim 10, wherein the cover has a hollow portion near the edge of the cover.

12. An electronic pad for receiving a strike, detecting the strike, and outputting a signal representative of the strike, comprising:

a bowl-shaped frame having a first surface and a second surface;

a cover that covers the first surface of the frame;

a chassis supporting the frame, and a striking sensor disposed to be in percussive communication with the second surface of the frame, the striking sensor for detecting and outputting a signal representative of a strike on the cover;

wherein the electronic pad further comprises a sheet sensor that is disposed near the outer edge of the frame; and wherein the sheet sensor is ring-shaped.

13. An electronic pad for receiving a strike, detecting the strike, and outputting a signal representative of the strike, comprising:

a bowl-shaped frame having a first surface and a second surface;

a cover that covers the first surface of the frame;

a chassis supporting the frame, and a striking sensor disposed to be in percussive communication with the second surface of the frame, the striking sensor for detecting and outputting a signal representative of a strike on the cover;

wherein a center portion of the cover is thicker than the other portions of the cover.

14. An electronic pad according to claim 13, wherein a surface of the cover is coated with a rubber primer.

15. An electronic pad according to claim 13, wherein a surface of the cover is formed to be flat.

16. An electronic pad for receiving a strike, detecting the strike, and outputting a signal representative of the strike, comprising:

a bowl-shaped frame having a first surface and a second surface;

a cover that covers the first surface of the frame;

a chassis supporting the frame, and a striking sensor disposed to be in percussive communication with the second surface of the frame, the striking sensor for detecting and outputting a signal representative of a strike on the cover;

wherein a surface of the cover has concentric concave and convex configurations in it.

17. A method for constructing an electronic pad comprising:

providing a bowl-shaped frame having a first surface and a second surface;

forming a cover that covers at least the first surface of the frame;

supporting the frame with a chassis;

disposing a sensor in percussive communication with the second surface of the frame;

employing a chassis to support the frame; and disposing a ring-shaped sheet sensor on the periphery of the chassis.

18. A method for constructing an electronic pad comprising:

providing a bowl-shaped frame having a first surface and a second surface;

forming a cover that covers at least the first surface of the frame;

supporting the frame with a chassis; and disposing a sensor in percussive communication with the second surface of the frame;

wherein forming a cover further comprises forming the cover so that a center portion of the cover is thicker than other portions of the cover.

19. A method according to claim 18, where forming a cover further comprises leaving a hollow portion in the cover near the periphery of the cover.

20. An electronic pad constructed according to the method of claim 18.

* * * * *